US005927925A

United States Patent [19]

Winkelmann

[11] Patent Number: 5,927,925

[45] Date of Patent: Jul. 27, 1999

[54] POLE SETTING GUIDE

[75] Inventor: Arnold C. Winkelmann, Waller, Tex.

[73] Assignee: Reliant Energy Incorporated, Houston, Tex.

[21] Appl. No.: 09/095,285

[22] Filed: Jun. 10, 1998

[51] Int. Cl.[6] ..... B66S 9/00

[52] U.S. Cl. ..... 414/23; 296/26

[58] Field of Search ..... 296/26; 414/23, 414/910, 911; 224/402, 488, 519

[56] References Cited

U.S. PATENT DOCUMENTS

| | | | |
|---|---|---|---|
| 2,056,883 | 10/1936 | Brown . | |
| 2,138,842 | 12/1938 | Drew . | |
| 2,249,907 | 7/1941 | Perkowski | 414/23 |
| 2,792,947 | 5/1957 | Weedman | 414/23 |
| 4,114,766 | 9/1978 | Decker et al. . | |
| 4,362,451 | 12/1982 | Thiermann, Sr. | 414/23 |
| 4,775,276 | 10/1988 | McMillan | 414/23 |
| 5,450,912 | 9/1995 | Cahill et al. | 414/23 |
| 5,458,389 | 10/1995 | Young | 296/26 |
| 5,476,352 | 12/1995 | Culbertson et al. | 414/23 |
| 5,658,033 | 8/1997 | Delaune | 296/26 |

FOREIGN PATENT DOCUMENTS

| | | |
|---|---|---|
| 646865 | 10/1962 | Italy . |
| 53524 | 2/1934 | Norway . |

*Primary Examiner*—Christopher P. Ellis
*Assistant Examiner*—Gregory A. Morse
*Attorney, Agent, or Firm*—Bracewell & Patterson, L.L.P.

[57] ABSTRACT

A pole setting guide device is provided for receiving and supporting a utility pole during its upright installation into a hole in the ground. The pole setting guide device includes a yoke assembly secured to a support column. The yoke assembly includes a shaft mounted transversely between side beams and a roller member rotatably mounted on the shaft. A hitch arm is transversely attached to the support column and connects the pole setting device to the vehicle's receiver hitch. The hitch arm includes a hole for receiving a pin for securing the pole setting device within the receiver hitch.

6 Claims, 4 Drawing Sheets

POLE SETTING GUIDE

BACKGROUND OF THE INVENTION

1. Field of the Invention

The present invention relates to the supporting and setting of a long poles, such as utility poles, during their installation into a hole in the ground.

2. Description of the Related Art

Frequently, a utility pole, such as a telephone or electric pole, must be set into a hole in an upright position. In general, these utility poles can be difficult to handle because they are long and heavy, often ranging to lengths of twenty feet or more and weighing several hundred pounds. In the past, a flat-bed or another large truck often included a mechanism permanently mounted to either its front end or its cargo bed for supporting and setting utility poles. Alternatively, instead of such a truck, several crew members would lift, carry, and set the pole within the hole.

Several different types of front end truck-mounted mechanisms existed to assist the crew with installing a utility pole. One such device included a rotatable drum mounted to the vehicle's bumper or frame. To install the pole, crew members lifted the pole onto the drum so that one end of the pole was set against the top of the hole and the middle portion of the pole rested on the drum. The truck then drove toward the hole, the drum rotating the pole vertically and dropping it into the hole. This pole setting device required the pole to be lifted onto the drum by crew members at the work site. Further, the load of the pole was sometimes placed on the bumper and not directly transfer to the vehicle's chassis. This device was also fixedly mounted to the vehicle and could not be readily removed to another vehicle without significant effort.

Another type of front end mounted pole setting device included structure for transporting the utility pole above the truck. These devices included a support structure above the truck's cargo bed and front end, and a mechanism for setting the pole into a hole located in front of the truck. Often, the mechanisms for setting included a complex array of pulleys, cables, and booms. This type of pole setting device had a complicated setting mechanism and cumbersome structure. Further, the load of the pole was sometimes placed on the bumper and not directly transferred to the vehicle's chassis. The device was also fixedly mounted to the vehicle's front end and cargo bed, and thus not readily removable from the vehicle. As a result, the available cargo space decreased and the truck's usefulness for anything other than pole installation became diminished.

Cargo bed mounted structures for setting a pole off the rear of a vehicle have also included complicated mechanisms. These mechanisms often included booms, clamps, and cranks. In many cases, these devices were used for setting but did not include a means for transporting the pole to the work site. With these pole setting devices, the pole had to be lifted onto the setting mechanism by several crew members at the work site. Further, the load of the pole was sometimes placed on the bumper or cargo bed and not directly transferred to the vehicle's chassis. These devices were also not readily removable, resulting in a decrease in valuable cargo space.

In many instances, however, the desired location for setting the pole was not accessible to large trucks or the use of such trucks could damage the surrounding terrain. In these situations, a pole setting dolly was used to transport the pole to the site and to set it into the hole. Alternatively, several crew members would carry the utility pole to the hole location and erect the pole by hand. Both of these methods for installing a utility pole had the disadvantage of requiring several crew members to be at the work site.

SUMMARY OF THE INVENTION

Briefly, the present invention provides an improved pole setting guide device for receiving and supporting a utility pole during its upright installation into a hole in the ground. The pole setting guide device of the present invention is versatile because it is easily mounted to and removed from a light weight or pick-up type vehicle, as it readily secures to the vehicle's standard receiver hitch. Moreover, because the pole setting device installs into the receiver hitch, the load of the pole is transferred to the frame or chassis of the vehicle. Furthermore, the pole setting guide permits the utility pole to be loaded and secured to the pole setting device and vehicle at the work yard by several crew members, transported by the vehicle to the site, and installed in the hole by just two crew members.

The pole setting guide device according to the present invention includes a yoke assembly, for receiving and supporting the utility pole which is secured to a support column. The yoke assembly includes a shaft mounted transversely between side beams. A roller member is rotatably mounted on the shaft to assist the crew member with guiding the pole during installation.

A hitch arm is transversely attached to the support column, forming a generally L-shaped device for supporting the load of the pole. The hitch arm connects the pole setting device to the vehicle's receiver hitch and provides a mechanism for transferring the load of the pole to the vehicle's chassis. Like the receiver hitch, the hitch arm includes a hole for receiving a pin which secures the pole setting device within the receiver hitch.

In operation, crew members at the work yard, storage facility, or other staging area secure a utility pole onto the yoke assembly of the pole setting device and to the cab of the vehicle. The vehicle then transports two crew members and the utility pole to the installation site. Once at the location, a crew member climbs into the cargo bed of the vehicle and lifts the end of the pole which is secured to the cab. Next, the crew member guides the pole over the roller member of the yoke assembly such that the foot of the pole abuts the top of the hole. A crew member within the cab of the vehicle then backs the vehicle toward the hole while the crew member in the cargo bed guides the pole into the hole. As the truck draws nearer to the hole, the pole becomes more upright as it rolls over the roller member and transfers more of the load of the pole from the crew member onto the pole setting device of the present invention and the vehicle's chassis. After the pole is installed, the pole setting device of the present invention can be removed by a crew member from the receiver hitch and placed in the cargo bed of the vehicle.

The present invention thus provides a pole setting guide device for receiving and supporting a utility pole during its upright installation into a hole without the need for permanently attaching the pole setting device to the vehicle. Further, it allows the load of the pole to be transferred to the chassis of the vehicle. Moreover, the present invention can be secured to the standard receiver hitch of a light weight truck or a pick-up truck so that the utility pole can be transferred to almost any location without damaging the surrounding terrain.

BRIEF DESCRIPTION OF THE DRAWINGS

A better understanding of the present invention may be had by reference to the following drawings and contained numerals therein of which.

DETAILED DESCRIPTION OF INVENTION

Figure 1:
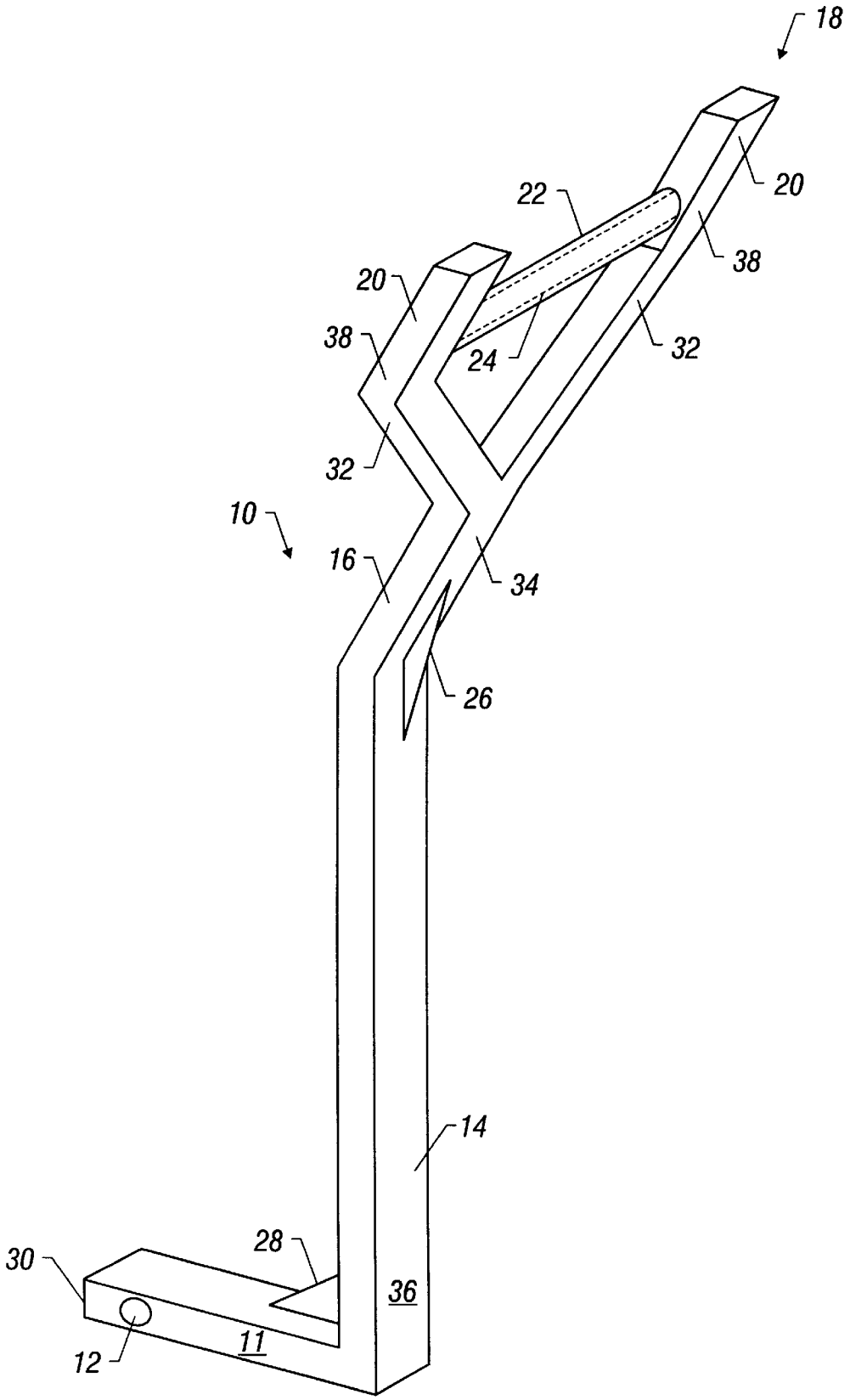
FIG. 1 is an isometric view of a pole setting guide device according to the present invention.

A pole setting guide device 10 according to the present invention is shown in the drawings. As will be discussed below, the pole setting guide device 10 receives and supports an elongable utility pole P (FIGS. 4–7) during the pole's upright installation into a hole H in a ground surfaces. The pole setting device 10 can receive any type of utility pole P (FIG. 4), such as a telephone or electrical pole, which is usually 20 or so feet in length. Typically, the utility pole is thus long and heavy and would without the present invention require several crew members working together to lift it.

Figure 2:
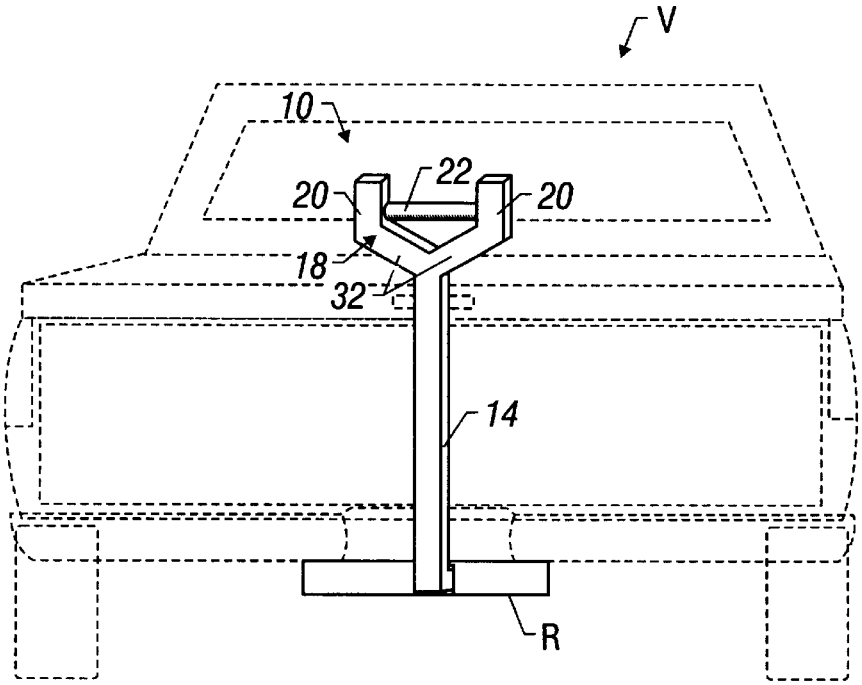
FIG. 2 is an isometric view of the present invention as installed on a vehicle.
Figure 3:
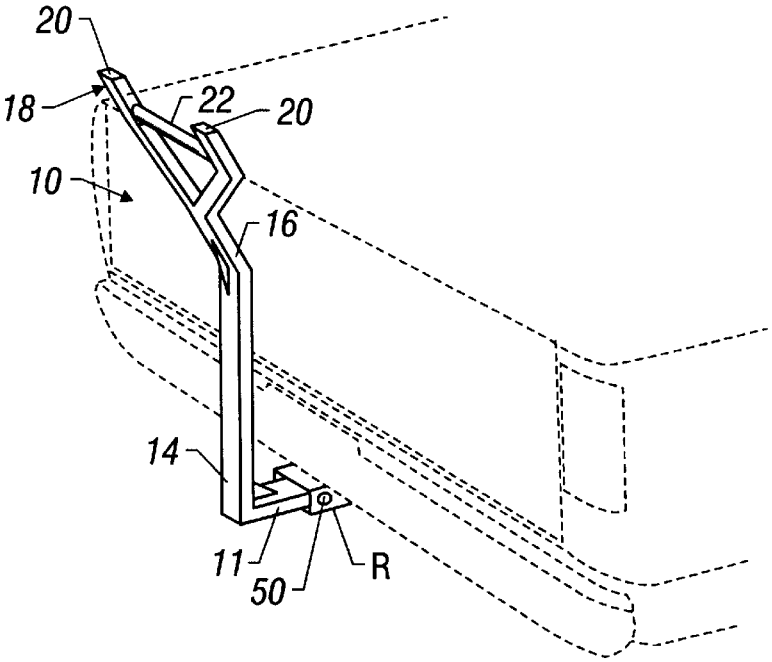
FIG. 3 is an isometric view of the present invention as installed upon a vehicle.
Figure 5:
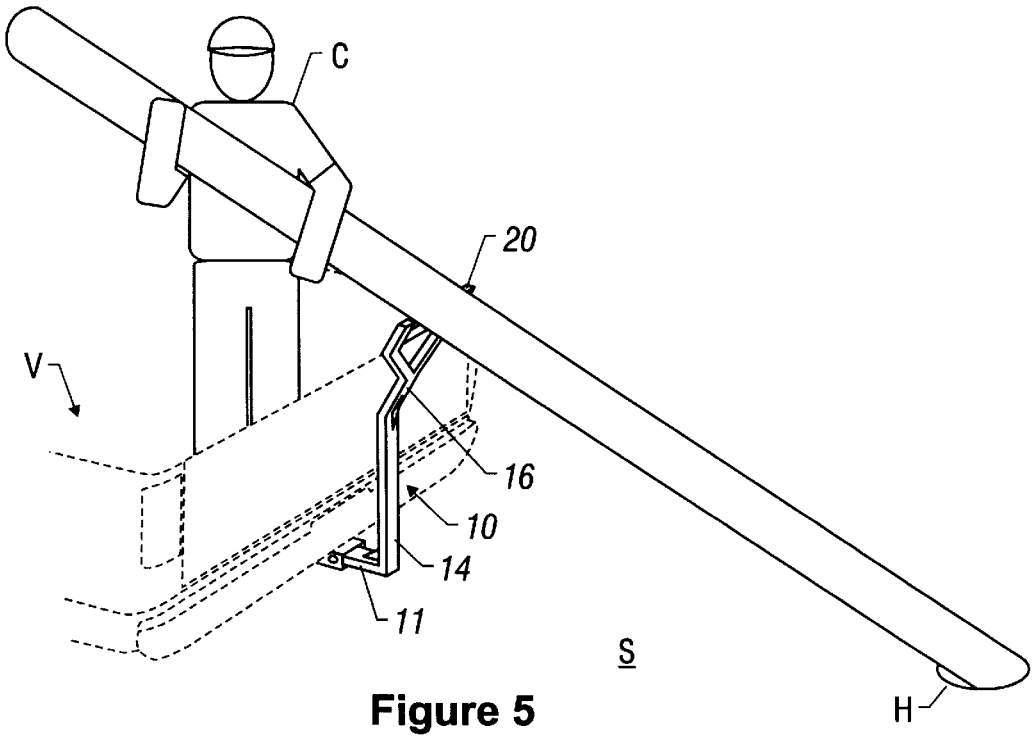
FIG. 5 is an isometric view of the present invention during installation of a utility pole.
Figure 6:
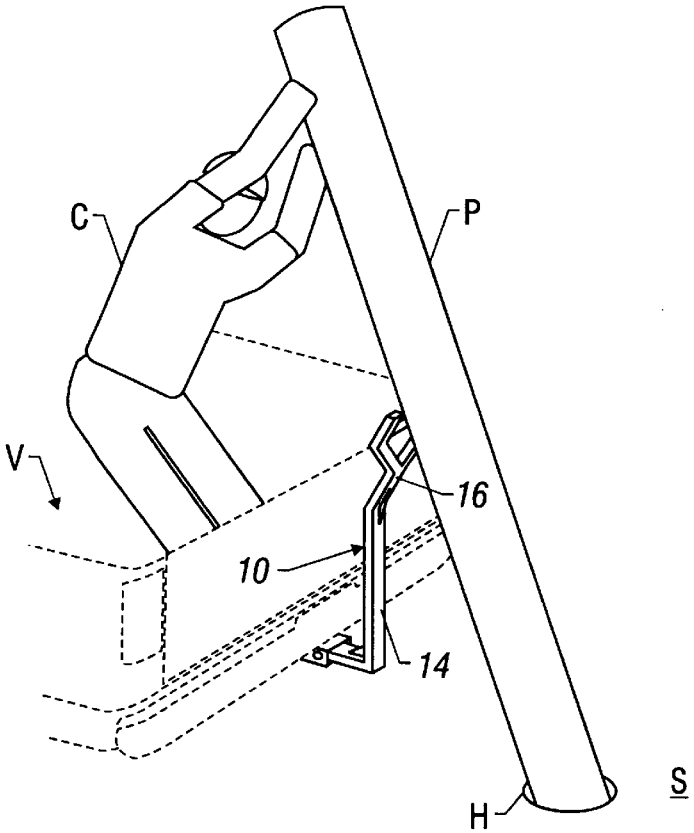
FIG. 6 is another isometric view of the present invention as used during the installation of a utility pole.
Figure 7:
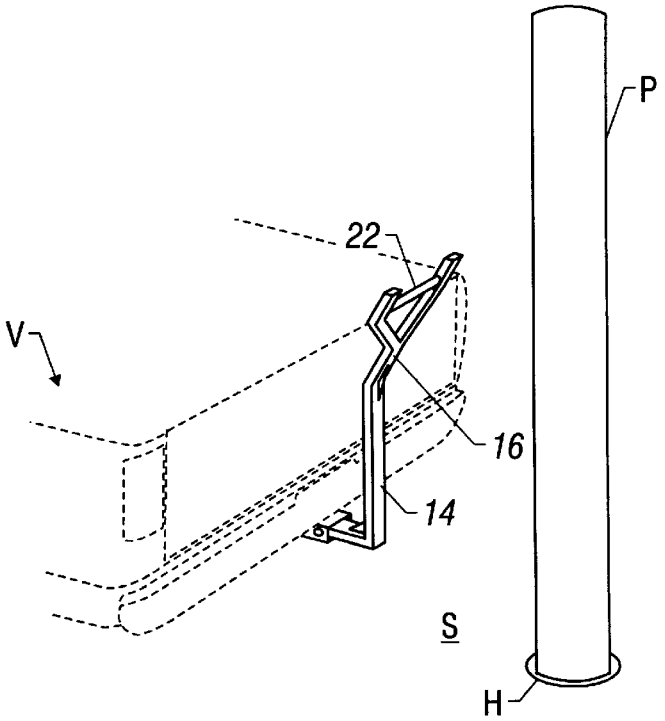
FIG. 7 is another an isometric view of the present invention on completion of installation of a utility pole from a vehicle.

As shown in FIGS. 1–3, the pole setting guide 10 of the present invention includes a yoke assembly 18 for receiving the utility pole P and guiding it into the hole H. Preferably, the pole setting device 10 is made of a suitable strength material such as a steel or other similarly strength metal. Additionally, the pole setting device 10 is constructed with channel or tubular members to provide sufficient rigidity to the structure during loading. In the preferred embodiment, the yoke assembly 18 includes two spaced uprights 20 which are generally parallel to one another. A shaft 24 is mounted transversely between the two uprights 20 and a roller member 22 is loosely and rotatably mounted over the transversely extending shaft 24. The roller member 22 allows the utility pole P to be easily rolled off of the pole setting device 10 when moved by a crew member C (FIG. 5).

At a base 38 of each of the two uprights 20 is a inwardly arm or lateral support member 32. The arms 32 space the uprights 20 at a preferred distance, typically a foot or more. The lateral support members 32 join one another at a yoke assembly base 34 to form the yoke 18 into a Y-shaped assembly. Alternatively, the bases of the two uprights 20 could be joined directly to one another with the two uprights 20 extending diagonally away from one another and spaced sufficiently apart to receive the shaft 24 and permit rotation of roller member 22. In general, the uprights 20 extend beyond the shaft to provide support and guidance for the utility pole P during installation.

The yoke assembly base 34 is mounted at an upper end of an extension arm 16. A lower end of the extension arm 16 is attached to an upwardly extending support column 14. The extension arm 16 spaces the yoke assembly 18 away from the arm 16 and thus away from a tailgate or other rear portions of the light weight vehicle or truck V. A support plate 26 is secured to the support column 14 and extension arm 16 to provide additional support and load transfer for the angled extension arm 16 during pole installation. This allows greater load transfer to the vehicle V and to its chassis during pole installation. Additionally, the extension arm 16 allows for easier control by the crew member C because more of the load of the pole P is taken by the pole setting device 10. Alternatively, the yoke assembly base 34 can be attached directly to the support column 14. A support column 14 without an extension arm 16 would still provide many of the benefits of the pole setting device 10 with an extension arm 16.

The support column 14 is attached at its base to a transversely extending hitch arm 11. The hitch arm 11 is a generally hollow tube or beam for securing the pole setting device 10 to the vehicle V. A support plate 28 connects the hitch arm 11 and the support column 14 and provides additional rigidity and strength to the pole setting device 10. The hollow hitch arm 11 is dimensioned to receive and slidably move into a standard vehicle receiver hitch R (FIG. 3). A connector hole 12 is there in the hitch arm 11 at a location aligned with a corresponding hole 50 in hitch R when a conventional connector pin or bolt inserted through arm 11 is properly positioned holes 11 and 50, thus securing the pole setting device 10 to the vehicle V.

Figure 4:
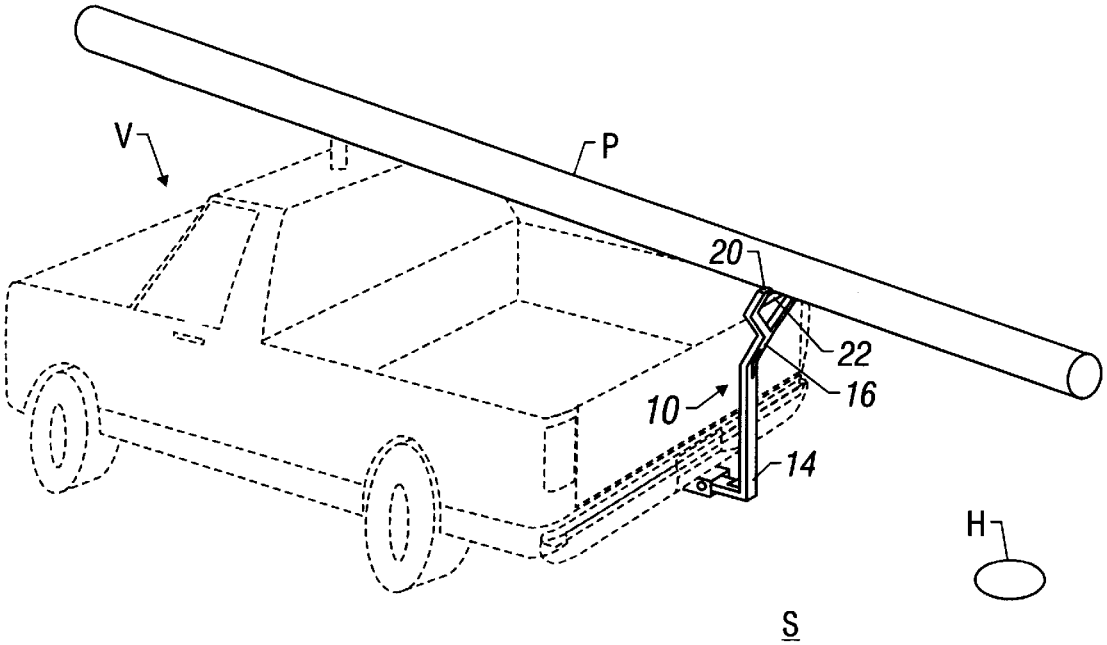
FIG. 4 is an isometric view of the present invention as installed on a vehicle supporting a utility pole.

As shown in FIGS. 2–4, the pole setting device 10 thus attaches to the receiver hitch R on the rear of the vehicle V. With the pole P supported at the back end of the vehicle V by the pole setting device 10 according to the present invention, the weight of the pole P is offset by the weight of the vehicle's engine. This offset or relative balance of weights provides for better stability and control when transporting and setting the pole P into the ground. Moreover, since the receiver hitch R on the vehicle V is secured to the vehicle's frame or chassis, the load of the pole P is not transferred to the body of the truck, but to its frame. Thus, the likelihood of damaging the vehicle's body, including the cab or cargo bed, due to the weight of the pole P is decreased.

Prior to arriving at the installation site, crew members at the work yard, storage facility, or other staging area place the utility pole P on the pole setting device 10 and on the cab of the vehicle V and secure it. The pole is transported to the installation site by a lightweight vehicle V or pick-up type truck with two crew members accompanying the vehicle V.

Once at the site (FIG. 5), a crew member C climbs into the back of the vehicle V and lifts the end of the pole P supported by the cab. The weight of the pole P on the roller member 22 causes the pole P to begin movement downwardly toward the hole H. The crew member C assists such movement and pushes on the pole P while guiding it toward the hole H. The pole guide 10 thus assists and eases the crew member's installation because it rolls about the shaft 24 as the pole P is eased toward the hole H.

Once the pole P abuts the top of the hole H, a second crew member within the cab of the vehicle V begins backing the vehicle V toward the hole H. As the vehicle draws nearer to the hole H, the crew member C in the back of the truck guides the pole into the hole H using the yoke assembly 18 for support. The pole setting device 10 transfers the pole's load to the chassis of vehicle V. The weight of the vehicle's engine prevents the vehicle V from imbalance or tipping during the installation process.

When the pole P is almost vertical (FIG. 7), it slides due to its own weight into the hole H and disengages from the pole setting device 10. After the pole P is installed, the pole setting device 10 can be removed by a crew member C from the receiver hitch R and placed in the back of the vehicle V. As can be appreciated, because the pole setting device 10 does not fixedly attach to the bed of the vehicle V, the vehicle can then be used to transport cargo other than utility poles. Moreover, because the pole setting device 10 is easily removed, there is no permanent loss of use of the vehicle's tailgate.

The foregoing disclosure and description of the invention is illustrative and explanatory thereof, and various changes in the size, shape, and materials, as well as in the details of illustrative construction and assembly, may be made without departing from the spirit of the invention.

What is claimed is:

1. A pole setting guide for a vehicle to support a utility pole during installation into a hole in the ground, the vehicle having a receiver hitch for transferring a load connected to the hitch to the frame of the vehicle, comprising:

a yoke assembly for receiving and supporting the pole during installation, comprising:

two side beams; and a shaft mounted transversely between the two side beams for receiving and support the pole during installation;

a support column having the yoke assembly mounted at an upper end and having a hitch arm at a lower end for connection to the receiver hitch;

a connector mechanism mounted with the hitch arm for coupling the support column to the receiver hitch and transferring the load of the pole from the yoke assembly to the frame of the vehicle.

2. The pole setting guide of claim 1, wherein the shaft includes a roller member mounted on the shaft.

3. The pole setting guide of claim 1, wherein each side beam of the yoke assembly extends beyond the shaft to provide lateral support to the utility pole during installation.

4. The pole setting guide of claim 1, wherein an extension arm angles the yoke assembly away from the vehicle.

5. The pole setting guide of claim 1, wherein the connector mechanism comprises a connector pin and the hitch arm includes a hole therein for receipt of the connector pin to couple the hitch arm to the receiver hitch.

6. A method for supporting a utility pole during installation into a hole in the ground using a pole setting guide mounted on a vehicle having a receiver hitch, comprising the steps of:

transporting the pole setting guide to site of the hole in a cargo bed of the vehicle;

attaching the pole setting guide to the receiver hitch connected to the vehicle frame at the rear of the vehicle;

positioning the pole on the pole setting guide;

transferring the load of the pole to the vehicle frame;

lowering a first end of the pole into the hole in the ground;

moving the vehicle towards the hole once the first end is in the hole;

supporting the pole on the pole setting guide during movement of the vehicle; and guiding the pole into the hole during movement of the vehicle.

* * * * *